US005978981A

United States Patent [19]

Nelson

[11] Patent Number: 5,978,981

[45] Date of Patent: Nov. 9, 1999

[54] HAIR CONTROL DEVICE FOR SPAS

[76] Inventor: John Nelson, 1811 Tramway Dr., Sandy, Utah 84092

[21] Appl. No.: 08/971,426

[22] Filed: Nov. 17, 1997

Related U.S. Application Data

[62] Division of application No. 08/680,020, Jul. 15, 1996, abandoned.

[51] Int. Cl.[6] ..... E04H 4/06

[52] U.S. Cl. ..... 4/541.1; 4/286; 4/504; 4/507; 210/163; 210/169

[58] Field of Search ..... 4/286, 287, 288, 4/289, 292, 504, 507, 509, 541.1–541.4; 210/163, 164, 169; 138/111, 115

[56] References Cited

U.S. PATENT DOCUMENTS 2,869,727 1/1959 Howe .
4,257,892 3/1981 Boersma .
4,402,094 9/1983 Sanders .
4,461,323 7/1984 Morikawa et al. .

*Primary Examiner*—Charles E. Phillips
*Attorney, Agent, or Firm*—Thorpe North & Western, LLP

[57] ABSTRACT

A hair control device for pools/spas and a method for using the same includes a grate disposable in the pump inlet of a pool/spa with a plurality of elongate flow channels extending between a first end of the grate and a second end of the grate. The elongate flow channels are isolated from one another so as to decrease turbulence and to prevent hair from tangling or knotting behind the grate in such a manner that a person's head is held under water. Preferably, the channels of the grate will be at least 18 inches long. The channels can be linear, or can be disposed in a helical pattern through the housing of the grate.

15 Claims, 4 Drawing Sheets

HAIR CONTROL DEVICE FOR SPAS

This application is a divisional of application Ser. No. 08/680,020, filed Jul. 15, 1996 abandoned.

BACKGROUND OF THE INVENTION

1. Field of the Invention

The present invention relates to a hair control device for pools and spas. More particularly, the present invention relates to a drain which prevents hair from becoming trapped in a pool/spa drain and potentially injuring users thereof and damaging the recirculating pump which is connected to the drain.

2. State of the Art

Over the last decade, there has been tremendous growth in the popularity of spas, pools and the like. In particular, spas which may be placed in a deck or even within a home have become more popular due, in large part, to the decrease in cost. As the use of spas has increased, however, there has been a rise in the number of drownings associated therewith.

Many people like spas because the high pressure streams of warm water sooth aches and pains, and assist in general relaxation. The recirculating pumps must withdraw a significant amount of water from the spas to generate the high pressure streams which are recirculated back into the water containment area. Unfortunately, the suction pressure generated by these pumps to draw sufficient water out of the water containment area has been the cause of numerous drownings. In one recent case, the suction generated by the pump was sufficient to hold a young girl under the water until someone was able to terminate the power supply to the pumps. Unfortunately, the young girl died.

In addition to the power of the pumps, many drownings are caused by the hair of a user passing through the drain grate and into the water recirculating line. The turbulence in the water causes the hair to tangle and knot in the water recirculating line after it has passed through the drain grate. The tangled/knotted hair cannot be withdrawn because the grate is fastened to the shell of the pool/spa. Unless someone is able to cut the tangled hair, the person will typically drown. If the person is able to pull free, the tangled/knotted hair is left in the recirculating line to be carried with the water flowing therethrough. Unless some additional screen is provided, the tangled/knotted hair will eventually end up in the pump where it may cause a considerable amount of damage.

There have been numerous attempts to overcome these concerns and make pools and spas safer. For example, in U.S. Pat. No. 5,167,041, there is disclosed a device which is configured to automatically turn off the pump in the event that flow into the recirculating line is blocked. Likewise, in U.S. Pat. No. 4,115,878, there is taught a safety drain arrangement which disables the ability of the pump to maintain a high suction state. Other devices for interrupting the pump when there is an obstruction are shown in U.S. Pat. Nos. 5,347,664 and 5,499,406.

While each of these devices prevents or substantially lessens the likelihood of accidental drowning due to a person being held against the drain grate, they do not address the concern of a person drowning because his or her hair has become tangled or knotted in the recirculating water flow line.

Thus there is a need for an apparatus and method for reducing the risk of drowning due to hair being caught in a recirculating water flow line of a pool or spa. Such an apparatus should be inexpensive to purchase and easy to install. Such a device should also not interfere with the proper operation of the recirculating pump or pumps.

SUMMARY OF THE INVENTION

Thus, it is an object of the present invention to provide an apparatus and method for preventing drownings in pools and spas which occur because of hair becoming tangled or knotted behind the drain grate.

It is another object of the present invention to provide such an apparatus and method which is inexpensive, easy to install and easy to operate.

It is yet another object of the present invention to provide such an apparatus and method which will not interfere with proper operation of the recirculating pump or pumps.

It is still another object of the present invention to provide such an apparatus and method which may be used with other devices to prevent accidental drownings.

The above and other objects of the invention are realized in specific illustrated embodiments of a hair control device for pools/spas and a method for using the same including a grate disposable in the pump inlet with a plurality of elongate flow channels extending between a first end of the grate and a second end of the grate. The elongate flow channels are isolated from one another so as to decrease turbulence and thereby reduce the risk of hair becoming tangled or knotted behind the grate in such a manner as to hold a person's head under water.

In accordance with one aspect of the present invention, the elongate channels are at least 6 inches long, thereby substantially reducing the risk of hair becoming tangled or knotted behind the grate. Preferably, the channels are more than 12 inches long, and most preferably between 18 and 24 inches long. At such a length, there is little likelihood that a person's hair will pass through the grate and tangle or knot on the opposite side sufficiently to prevent the person from pulling his or her head free.

In accordance with another aspect of the present invention, the elongate channels are disposed in a linear array, each channel extending the length of the grate. In the alternative, each of the elongate channels can be disposed in a helical manner so as to enable channels which are longer than the grate. Thus, for example, a grate which is only 12 inches may be used in a tight area, but the helically disposed channels are 18 inches long, thereby reducing the risk that the hair will tangle or knot on the other side of the grate.

The method of the present invention includes disposing a plurality of elongate tubes or a grate formed by a plurality of elongate channels adjacent to the water containment area of a pool or spa. The tubes or channels are disposed so as to allow water flow therethrough, while minimizing turbulence which could tangle or knot hair entering the tubes or channels. Preferably, the tubes or grate are disposed so as to extend slightly into the water containment area. Thus, the tubes or grate act as a conventional grate to prevent items from flowing into the recirculating water flow line, while minimizing the risk of death or injury due to a person's hair getting tangled or knotted therein.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1:
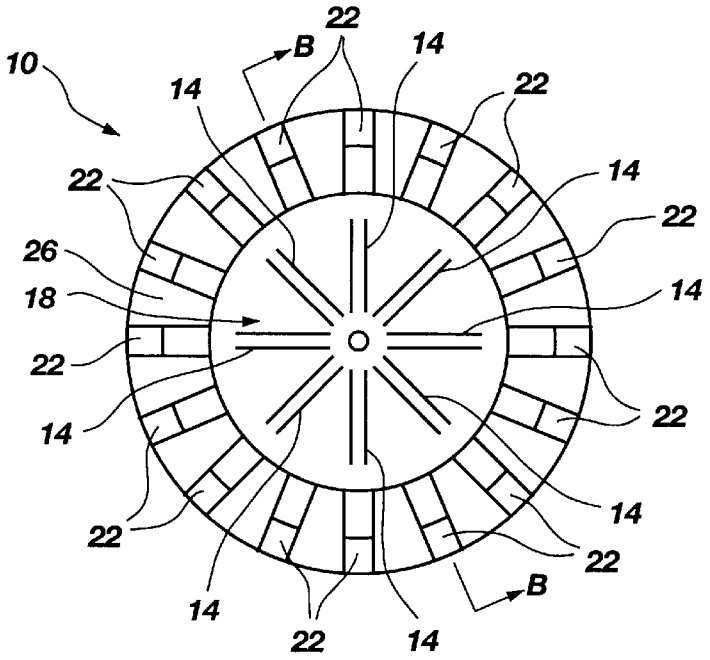
Fig. 1 (PRIOR ART)
FIG. 1 shows a front view of a drain grate made in accordance with the principles of the prior art.

Referring to FIG. 1, there is shown a front, end view of a drain grate, generally indicated at 10, made in accordance with the principles of the prior art. The drain gate 10 has a first plurality of interconnecting ribs 14 disposed along a front face 18 of the grate to prevent swimming suits, debris and other materials from accidentally being sucked into the water recirculating line in which the drain gate 10 is disposed. Extending outwardly and rearwardly from the first plurality of ribs 14 is a second plurality of ribs 22. The second plurality of ribs 22 serve the same function as the first plurality of ribs 14. Namely, the ribs 22 prevent foreign materials from entering the water recirculating line. The second plurality of ribs 22, however, also serve a safety function. If something is placed generally flat against the front face 18, water will still flow into the recirculating water flow line through the channels 26 (only one of which is identified in FIG. 1A) between the second plurality of ribs 22. In such a manner, the drain gate serves to inhibit high suction pressures that might hold a person under water. If the front face 18 is blocked, water will still flow in through the channels 26, thereby keeping suction pressure within reasonable limits.

Figure 1A:
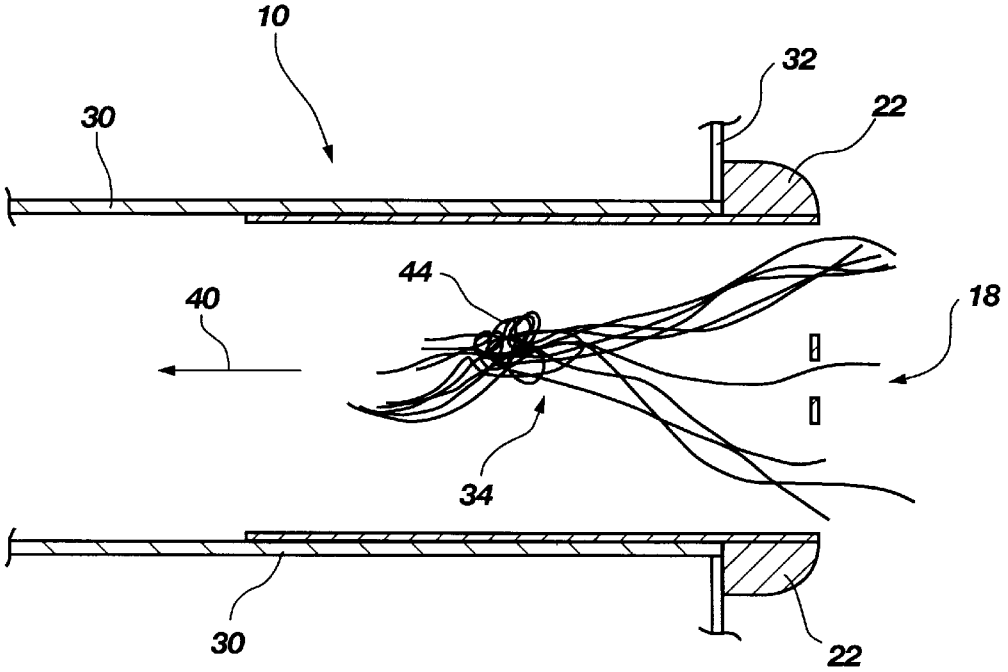
Fig. 1A (PRIOR ART)
FIG. 1A shows a cross-sectional view of the prior art drain grate.

Referring now to FIG. 1A, there is shown a cross-sectional view of the drain gate 10 mounted within a water recirculating line 30 which extends from a shell 32 of a spa. The recirculating water flow line 30 is typically connected directly to the recirculating pump (not shown).

Also shown in FIG. 1A are a plurality of hairs, generally indicated at 34. The hairs 34 are drawn in through the drain grate 10 by the water flow indicated by arrow 40. Typically, the hairs 34 will enter the water recirculating line 30 through several of the openings in the front face 18 of the drain gate 10, and/or through the channels 26 (FIG. 1A) extending rearwardly from the face. Within the water recirculating line 30 is a reasonably large amount of turbulence. The turbulence causes the hairs 34 to knot and tangle with each other. Within a short amount of time, a knot 44 develops. As the person whose hairs are tangled/knotted attempts to move his or her head, the knot 44 catches on the ribs 14 and/or 22 of the drain gate 10. If the knot is small enough, the person can usually jerk his or her head with sufficient force that the hair breaks. The knot 44 then is passed on to the pump where it may cause damage. If a sufficient amount of hair is knotted or tangled, the person will be unable to pull it free. To allow the person to get out the pool or spa, the only two options are cutting the hair or removing the drain gate 10. Typically, neither is a viable option when the person's head is being held underwater.

Figure 2:
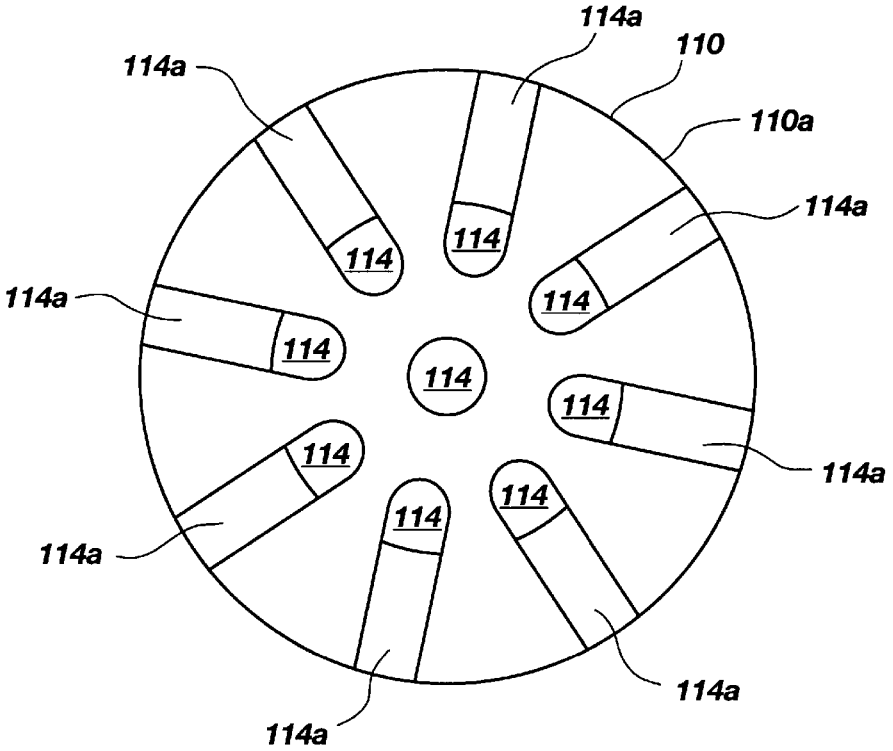
FIG. 2 shows a front, end view of a grate having elongate water flow channels in accordance with the teachings of the present invention.

Referring now to FIG. 2, there is shown a front view of a grate made in accordance with the principles of the present invention. The grate, generally indicated at 100, includes a housing 110 with a first end 110*a*, shown in FIG. 2, and a second end 110*b*. A plurality of channels 114 are formed in the housing 110 to extend from the first end 110*a* to the second end 110*b*. To prevent the channels 114 from being blocked by covering of the front face 118, each channel disposed about the outside of the housing has an outwardly flared portion 114*a* at the first end 110*a*.

Figure 2A:
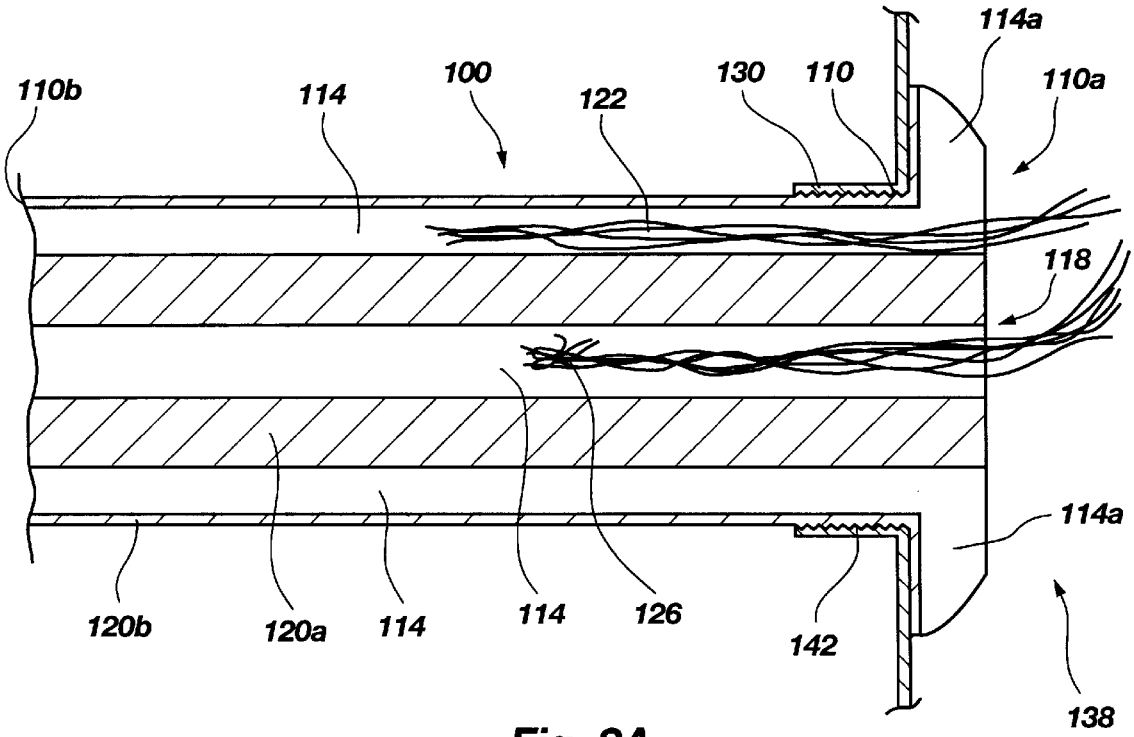
FIG. 2A shows a cross-sectional view of one embodiment of the drain grate shown in FIG. 2.

Referring now to FIG. 2A, there is shown a cross-sectional view of the grate 100. The channels 114 extend from the first end 110*a* of the housing 110 to the second end 110*b* and are formed by inner walls 120*a* and an outer wall 120*b*. Unlike the prior art, there is no area of high turbulence immediately behind the front face 118 in which hair can become tangled or knotted. Rather, when hair 122 is sucked into the channels, it is subjected to less turbulence than with the grates of the prior art. Additionally, because the channels 114 keep each group of hair isolated, any knots 126 which form, provide only an inconvenience to the person, as opposed to a significant threat to health. As the person withdraws his head or her head, none of the hair must be cut or otherwise damaged. This also benefits the pump as it does not receive large knots of hair with the water from the water recirculating line.

Additionally, if a knot were to form and be sufficiently large to inhibit flow through one of the channels 114, the suction generated by the pump will not generally be sufficient to hold the hair 122 in place because the rate of flow can increase through the other channels. Thus, unless nearly all of the channels 114 were filled with hair 122, there is little risk that the person's hair may be held by the suction.

To keep the risk of tangling/knotting of the hair to a minimum, the housing 110 of the grate 100 should be at least 6 inches long. In a more preferred embodiment, the housing 110 is 12 inches long, and in a most preferred embodiment, the housing 110 of the grate 100 is at between 18 inches and 24 inches. This length is desirable because it is rare that a significant amount of hair would extend through the housing and become tangled or knotted on the opposing side. Of course, a longer housing provides additional safety against accidental drowning due to such circumstances.

While many variations of the housing may be used, it is contemplated that each channel 114 be between 0.25 and 0.5 inches in diameter. A primary factor in diameter size will be the size of the pumps and filter system. Swimming pools will typically have larger channels than will spas and the like. Of course, channels 114 of varying sizes may also be used provided that the size of the channel is sufficiently small to serve the screening requirement to keep rings, leaves and debris from being drawn into the flow channel and damaging the pump. Thus, the grate forms a screen to protect the pump, while avoiding the risk to users due to have becoming tangles/knotted behind the screen.

In use, the housing 110 is typically disposed so that the first end 110*a* is positioned within the water containment area, generally indicated at 130, of the pool or spa. To hold the housing 110 in place, the housing has threads 130 adjacent the first end 110*a* to mate with corresponding threads which are placed in the shell 142 of conventional pools and spas at an inlet. As shown in FIG. 2A, the housing 110 is disposed in the inlet. Other mechanisms such as adhesives or clamps may also be used to hold the housing 110 in proper position with respect to the shell 142 of the pool or spa.

In the alternative, the housing 110 could be formulated to serve as the water recirculating line itself. Thus, the conventional recirculating line could be removed from the pool/spa, and the housing 110 substituted therefor.

Figure 2B:
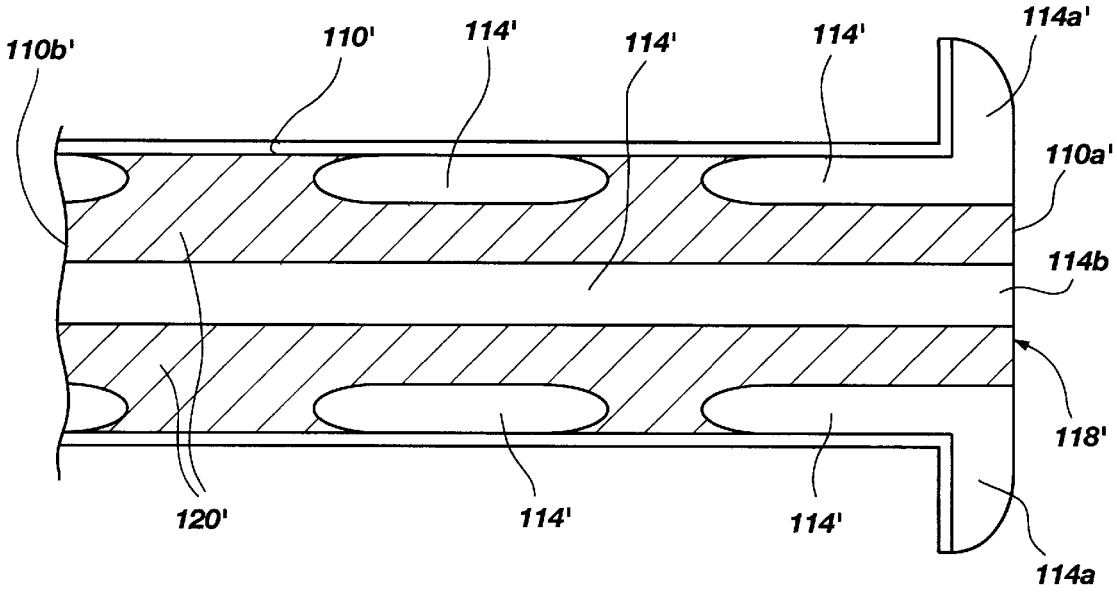
FIG. 2B shows an cross-sectional view of an alternate embodiment of the grate shown in FIG. 2.

Referring now to FIG. 2B, there is shown a cross-sectional view of another embodiment of the grate of FIG. 2, generally at 100'. The housing 110' includes a first end 110*a'* and a second end 110*b'* with a plurality of channels 114' extending therebetween. Like the embodiment shown in FIG. 2A, the channels 114' which are disposed about the outside of the housing 110' each have flared portion 114*a'* adjacent the front face 118' to prevent the channels 114' from becoming blocked. Unlike the embodiment shown in FIG. 2A, the channels 114' disposed about the perimeter of the housing 110' are not linear. Rather, the channels 114' are disposed in a helical pattern. In such an arrangement, the length of the channels 114' can be extended without extending the length of the housing. This is advantageous because many spas do not have sufficient room about them to place a grate which is several feet long. By using a grate 100' with helically disposed channels 114', however, additional channel length may be provided, and the risk that a user's hair will be come caught is significantly diminished. For example, a grate 100' which is 1 foot long could have channels which are 18 inches long, thereby providing approximately the same level of protection as an 18 inch housing with linear channels. Of course, the middle channel 114*b'*, defined by the inner walls 120', will be shorter than the other channels.

Figure 3:
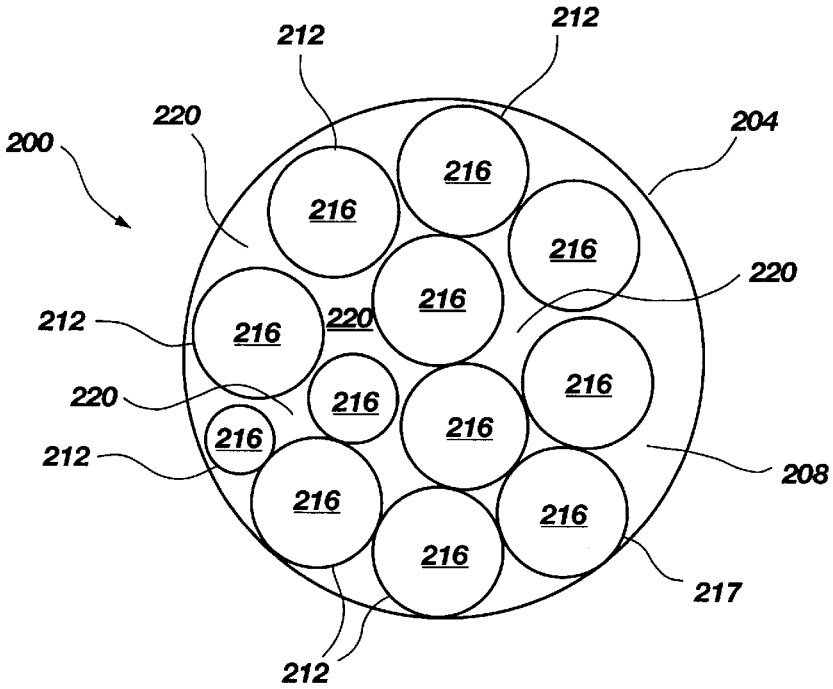
FIG. 3 shows a front, end view of another embodiment of a drain grate made in accordance with the teachings of the present invention.

Referring now to FIG. 3, there is shown an end view of an alternate embodiment of the present invention. Instead of a housing with a plurality of channels formed therein, the grate, generally indicated at 200, has container formed by a generally cylindrical outer wall 204. The outer wall 204 defines a first, large channel 208. Disposed within the large channel 208 are a plurality of elongate tubes 212. The tubes 212 are disposed so as to substantially fill the large channel 208. Inside of each tube 212 is a second, smaller channel 216. As shown in FIG. 3, the tubes 212 need not be of any particular size. Rather, they must only be small enough to screen out materials which are likely to damage the motor.

Disposed between the tubes 212 are a plurality of flow paths 220 which will allow fluid to flow therethrough at a similar rate as the channels 216 in the tubes 212. Preferably, the tubes 212 are nested within the outer wall 204 with sufficient concentration that each flow path with be bounded by as few tubes as possible—thereby preventing any tangles or knots from wedging in between the tubes. Thus, the tubes 212 serve to break-up the large channel into a plurality of smaller, elongate channels.

Figure 3A:
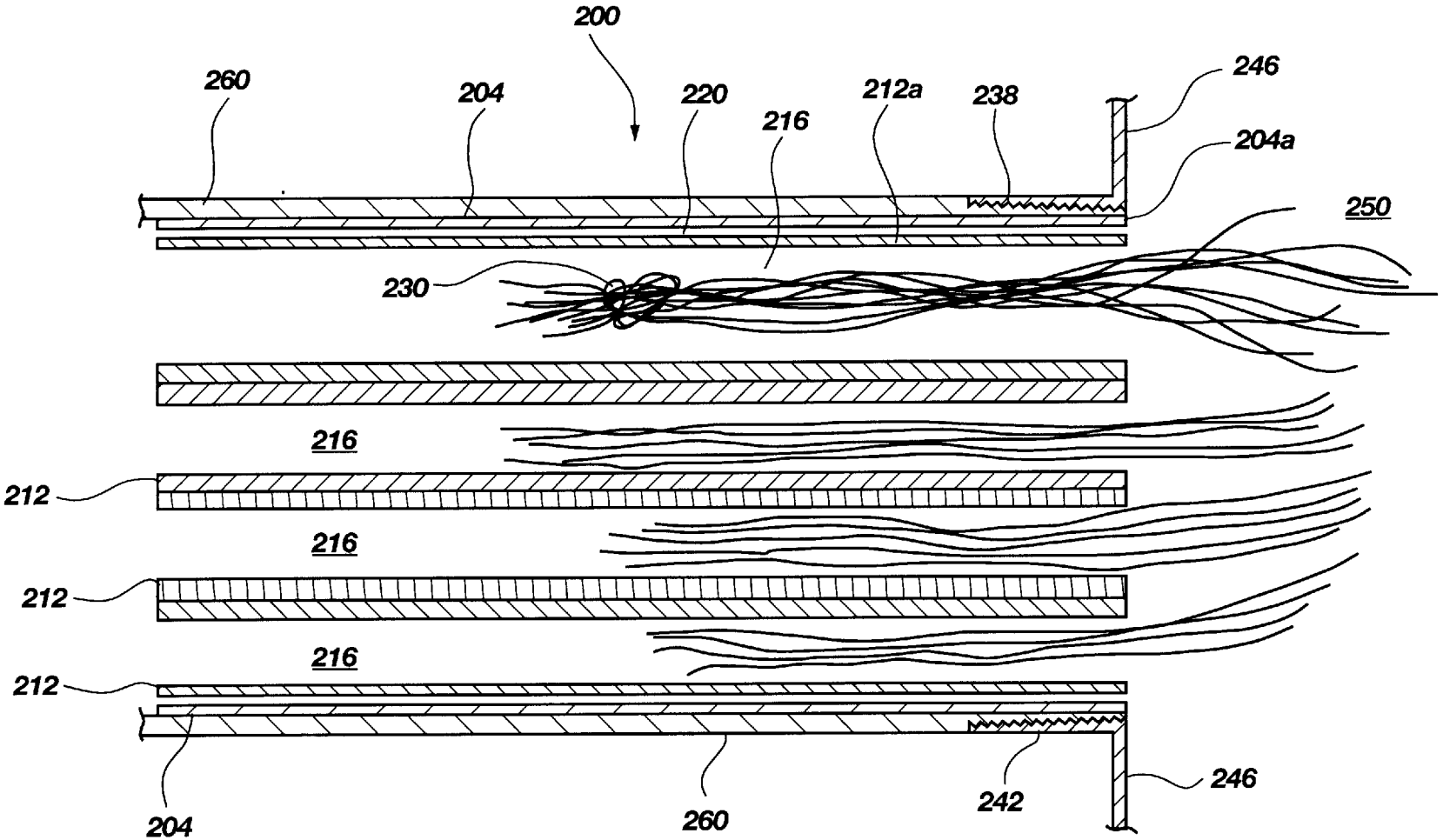
FIG. 3A shows a cross-sectional view of the embodiment shown in FIG. 3.

Referring now to FIG. 3A, there is shown a cross-sectional view of the grate 200, including the cylindrical outer wall 204 and the tubes 212 which are disposed in the channel 208. As hair is drawn into the tubes 212 and flow path 220, the lower turbulence provided decreases tangling or knotting. In the event that a knot 230 does develop in the hair, as shown in tube 212*a,* there is no risk to the person, as the there is nothing to prevent withdrawal of the knotted hair. While the water flowing through the tubes will create some drag, the flow of water through the grate does not hold the hair in place.

The outer wall 204 has a threaded first end 204*a*. The threads 238 are used to engage threads 242 disposed in the inlet of a pool or spa shell 246, a fragmented view of which is shown in FIG. 3A. Unlike the embodiment discussed with respect to FIGS. 2 through 2B, the first end 204*a* of the container's outer wall 204 will typically not extend passed the pool/spa shell 242 and into the water containment area 250. Rather, the first end 204*a* of the outer wall 204 will typically sit generally flush with the shell 246. Of course, the pool/spa shell 246 could be formed with a water recirculating line 260 which is divided into numerous smaller channels in a similar manner to the grate 200 shown in FIGS. 3 and 3A. This may be either by a plurality of smaller tubes, as shown in FIGS. 3 and 3A, or by some insert which divides the water recirculating line 260 into a plurality of smaller channels, thereby providing a screening function while preventing hair from becoming tangled on an opposing side of the grate.

Thus, there is disclosed an improved hair control device for pools, spas and the like. The device significantly improves safety, while having little impact on the recirculating operations of the pool, spa, etc. Those skilled in the art will appreciate that numerous modifications can be made without departing from the scope or spirit of the invention. The appended claims are intended to cover such modifications.

What is claimed is:

1. A method for preventing accidental drownings in pools/spas caused by a victim's hair becoming tangled/knotted in a water recirculating line extending from a water containment area of the pool/spa to a water recirculating pump due to turbulence within the water recirculating line, the method comprising:

a) selecting a fluid flow housing having a plurality of smaller, tubular, elongate flow channels at least 6 inches in length extending therethrough and being configured for nesting within the water recirculating line; and b) disposing the fluid flow container in the water recirculating line adjacent an opening to the water containment area so that the smaller, tubular, elongate channels extend to the opening of the water recirculating line so as to divide the water recirculating line into a plurality of smaller water recirculating lines adjacent the water containment area.

2. The method according to claim 1, wherein the method comprises, more specifically, selecting a fluid flow container having substantially linear flow channels.

3. The method according to claim 1, wherein the method further comprises selecting a fluid flow container having a plurality of fluid flow channels, the majority of which are at least 18 inches long.

4. The method according to claim 1, wherein the method comprises, more specifically, selecting a fluid flow container having helical flow channels.

5. The method according to claim 1, wherein the method comprises, more specifically, disposing the fluid flow container adjacent the containment area so that the fluid flow container forms a grate.

6. The method according to claim 1, wherein the method comprises selecting a fluid flow container having a plurality of flow channels formed by a plurality of tubes.

7. The method according to claim 6, wherein each of the tubes has a common diameter.

8. The method according to claim 6, wherein at least two of the tubes have different diameters.

9. A method for preventing accidental drownings in pools/spas wherein a victim's hair becomes tangled/knotted in a water recirculating line extending from a water containment area of the pool/spa to a water recirculating pump due to turbulence within the water recirculating line, the method comprising:

a) selecting a water recirculating line having a plurality of walls disposed within a first portion thereof so as to divide the first portion into a plurality of elongate water flow channels, each of the flow channels being at least 6 inches long; and b) disposing the first portion of the water recirculating line adjacent the water containment area so as to inhibit the tangling/knotting of hair within the first portion as water flows therethrough.

10. The method according to claim 9, wherein the method comprises selecting a water recirculating line wherein each of the water flow channels is at least 12 inches long.

11. The method according to claim 10, wherein the method comprises, more specifically, selecting a water recirculating line wherein each of the water flow channels is at least 18 inches long.

12. The method according to claim 9, wherein the method further comprises disposing the water recirculating line such that the water flow channels form a grate adjacent the water containment area.

13. The method according to claim 9, wherein the method comprises, more specifically, selecting a water recirculating line having a plurality of flow channels, each of the flow channels having a common diameter.

14. The method according to claim 9, wherein the method comprises, more specifically, selecting a water recirculating line having a plurality of flow channels of different diameters.

15. The method according to claim 9, wherein the method comprises, more specifically, forming water recirculating line with a plurality of flow channels longer than 18 inches and disposing the water recirculating line so that the plurality of flow channels form a grate adjacent the water containment area.

* * * * *